US010617922B2

(12) United States Patent
Kaminskas et al.

(10) Patent No.: US 10,617,922 B2
(45) Date of Patent: Apr. 14, 2020

(54) ADJUSTMENT DEVICE FOR USE WITH ATHLETIC EQUIPMENT

(71) Applicant: Lax Bash Tournaments, LLC, Washington Township, MI (US)

(72) Inventors: Michael Anthony Kaminskas, Washington Township, MI (US); Brian Michael Kaminskas, Washington Township, MI (US); Cameron Christopher Holding, Byron Center, MI (US)

(73) Assignee: Lax Bash Tournaments, LLC, Washington Township, MI (US)

( * ) Notice: Subject to any disclaimer, the term of this patent is extended or adjusted under 35 U.S.C. 154(b) by 0 days.

(21) Appl. No.: 16/134,950

(22) Filed: Sep. 18, 2018

(65) Prior Publication Data

US 2020/0086192 A1 Mar. 19, 2020

(51) Int. Cl.

| | |
|---|---|
| ***A63B 59/20*** | (2015.01) |
| ***A63B 60/42*** | (2015.01) |
| *A63B 102/14* | (2015.01) |
| *B25B 25/00* | (2006.01) |

(52) U.S. Cl.

CPC ..... *A63B 60/42* (2015.10); *A63B 59/20* (2015.10); *A63B 2102/14* (2015.10); *B25B 25/005* (2013.01); *Y10T 29/53683* (2015.01)

(58) Field of Classification Search

CPC ..... B25B 25/005; Y10T 29/53683
USPC ..... 473/513; 81/3.7, 9.3, 845
See application file for complete search history.

(56) References Cited

U.S. PATENT DOCUMENTS 1,170,334 A * 2/1916 Riggs ..... B25B 7/00 81/303
1,982,630 A * 12/1934 Bent ..... B25B 25/005 140/93 R
2,774,265 A * 12/1956 Foner ..... B25B 27/0035 81/3.7
2,871,738 A * 2/1959 Abbiati ..... B25B 25/005 81/9.3
4,102,533 A * 7/1978 Ida ..... A63B 49/12 473/534
4,485,696 A * 12/1984 Bieganski ..... H02G 1/1212 30/90.1
4,809,567 A * 3/1989 Bongard ..... B25B 27/0021 29/239
4,995,608 A * 2/1991 von Hackewitz ..... A63B 51/12 473/534

(Continued)

*Primary Examiner* — Mark S Graham
(74) *Attorney, Agent, or Firm* — Burris Law, PLLC

(57) ABSTRACT

The present disclosure provides an adjustment device for use in adjusting walls of athletic equipment that includes a base bracket defining an aperture secured around one end of a rod or resilient member, and a secondary bracket defining a corresponding aperture secured around an opposite end of the rod or resilient member. The base bracket and secondary bracket each include a receiving portion configured to receive and lock walls of the athletic equipment. In one form, a knob or arm is secured to the rod such that the secondary bracket is moved in a direction away from the base bracket. The base bracket and secondary bracket may include at least one protection member and/or the receiving portion of the base bracket and secondary bracket may include a barrier member to protect the walls of the athletic equipment.

20 Claims, 11 Drawing Sheets

(56) References Cited

U.S. PATENT DOCUMENTS

| | | | | |
|---|---|---|---|---|
| 5,029,857 | A * | 7/1991 | von Hackewitz | A63B 51/12 473/534 |
| 2003/0181271 | A1* | 9/2003 | Mitzak | A63B 51/12 473/513 |
| 2005/0082730 | A1* | 4/2005 | Murray | B25B 5/067 269/166 |
| 2009/0199681 | A1* | 8/2009 | Thayer | B25B 1/103 81/9.3 |

* cited by examiner

ADJUSTMENT DEVICE FOR USE WITH ATHLETIC EQUIPMENT

FIELD

The present disclosure relates generally to an adjustment device for athletic equipment and more particularly to an adjustment device for a lacrosse head.

BACKGROUND

The statements in this section merely provide background information related to the present disclosure and may not constitute prior art.

Modern lacrosse sticks, also known as crosses, include a plastic molded head which is attached to a metal shaft. Some components of the head include a neck, nylon or leather strings to form a pocket, and sidewalls in which the strings are attached. Lacrosse league rules have established dimensional requirements for crosses and are governed by organizations such as the National Collegiate Athletic Association (NCAA) for collegiate players or the Federation of International Lacrosse (FIL) for international players. For example, in men's lacrosse, the NCAA requires the distance between the sidewalls of the head to be at least 3 inches at the narrowest point and at least 6 inches at the widest point. In women's lacrosse, the NCAA requires the distance between the sidewalls of the head to be at least 3 inches at the narrowest point and at least 7 inches at the widest point.

However, the distance between the sidewalls may narrow, such as for example during face-off from pushing the lacrosse stick against the ground. The pressure compresses the lacrosse head and may cause the dimensions to be non-compliant with the league rules. Random inspections are performed to ensure compliance with the dimensional requirements and a player may be disqualified if those requirements are not met. Therefore, it is important to keep the head at the proper width in order to avoid disqualification.

These issues associated with non-conformity of lacrosse equipment relative to specific lacrosse league rules, among other issues with lacrosse equipment, are addressed by the present disclosure.

SUMMARY

In one form of the present disclosure, a device for repositioning walls of athletic equipment is provided that comprises an adjustment member, a base bracket, and a secondary bracket. The base bracket is secured around one end of the adjustment member and includes a receiving portion configured to receive and lock a wall of the athletic equipment. The secondary bracket is secured around an opposed end of the adjustment member and includes a receiving portion configured to receive and lock a wall of the athletic equipment.

In one variation, the adjustment member is a resilient extension. The resilient extension may be a compression spring configured to apply force to move the base bracket and secondary bracket in opposite directions.

In another variation, the adjustment member is a rod operable to extend. The rod includes a rotatable handle and when the handle is rotated, the rod extends such that the base bracket and secondary bracket move in a direction away from each other. The rod may be threaded.

In a further variation, the device may further include at least one protection member disposed on each of the base bracket and the secondary bracket for protecting a surface of the walls of the athletic equipment. The protection member may be disposed within a cavity located on a front face of the base bracket and on a front face of the secondary bracket where a portion of the protection member protrudes from the cavity. Alternatively, the protection member is a protective strip on at least one surface of each of the base bracket and the secondary bracket.

In yet another variation, at least one surface of the receiving portion of the base bracket and the secondary bracket includes a barrier member for protecting a surface of the walls of the athletic equipment. The barrier member may be disposed within a cavity or is a protective strip located on the at least one surface of the receiving portion of each of the base bracket and the secondary bracket.

In further variations, the receiving portion of the base bracket and the secondary bracket may define a slot. The base bracket and the secondary bracket may be made of a material selected from the group consisting of thermoplastic, metal, carbon fiber, and combinations thereof. The base bracket and the secondary bracket may be symmetrical.

In another form of the present disclosure, an adjustment device for use in adjusting sidewalls of a lacrosse head proximate a pocket is provided. The adjustment device includes a rod having an externally threaded portion and a head portion, a base bracket defining an aperture and rotatably secured around head portion of the rod, a secondary bracket defining a corresponding aperture having internal threads configured to engage with the externally threaded portion of the rod, and a knob secured to the rod. The base bracket and the secondary bracket each include a receiving portion configured to receive and lock the sidewalls of the lacrosse head. The rod and the knob rotate together and are operable to move the secondary bracket in a direction away from the base bracket. According to this form, the knob may be secured to the rod with a stabilizing pin that extends through both the knob and the rod.

In another form of the present disclosure, an adjustment device for use in adjusting walls of athletic equipment is provided that includes a resilient member, a base bracket secured around one end of the resilient member and a secondary bracket secured around an opposed end of the resilient member. The base bracket and secondary bracket each include a receiving portion configured to receive and lock a wall of the athletic equipment. In one variation, the resilient member is a compression spring configured to apply force to move the base bracket and the secondary bracket in opposite directions.

According to various forms of the adjustment device, the receiving portions may define a slot. Each of the base bracket and the secondary bracket may be a material selected from the group consisting of thermoplastic, aluminum, steel, carbon fiber and combinations thereof. The base bracket and the secondary bracket may be symmetrical. The adjustment device may further include at least one protection member disposed on each of the base bracket and the secondary bracket proximate the sidewall of the lacrosse head. The protection member may be disposed within a cavity located on a front face of the base bracket and a front face of the secondary bracket where a portion of the protection member protrudes from the cavity and/or the protection member is a protective strip on at least one surface of each of the base bracket and the secondary bracket.

Furthermore, at least one surface of the receiving portion of the base bracket and the secondary bracket may include a barrier member for protecting a surface of the sidewalls of the lacrosse head. The barrier member is at least one of disposed within a cavity or is a protective strip located on the at least one surface of the receiving portion of each of the base bracket and the secondary bracket.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
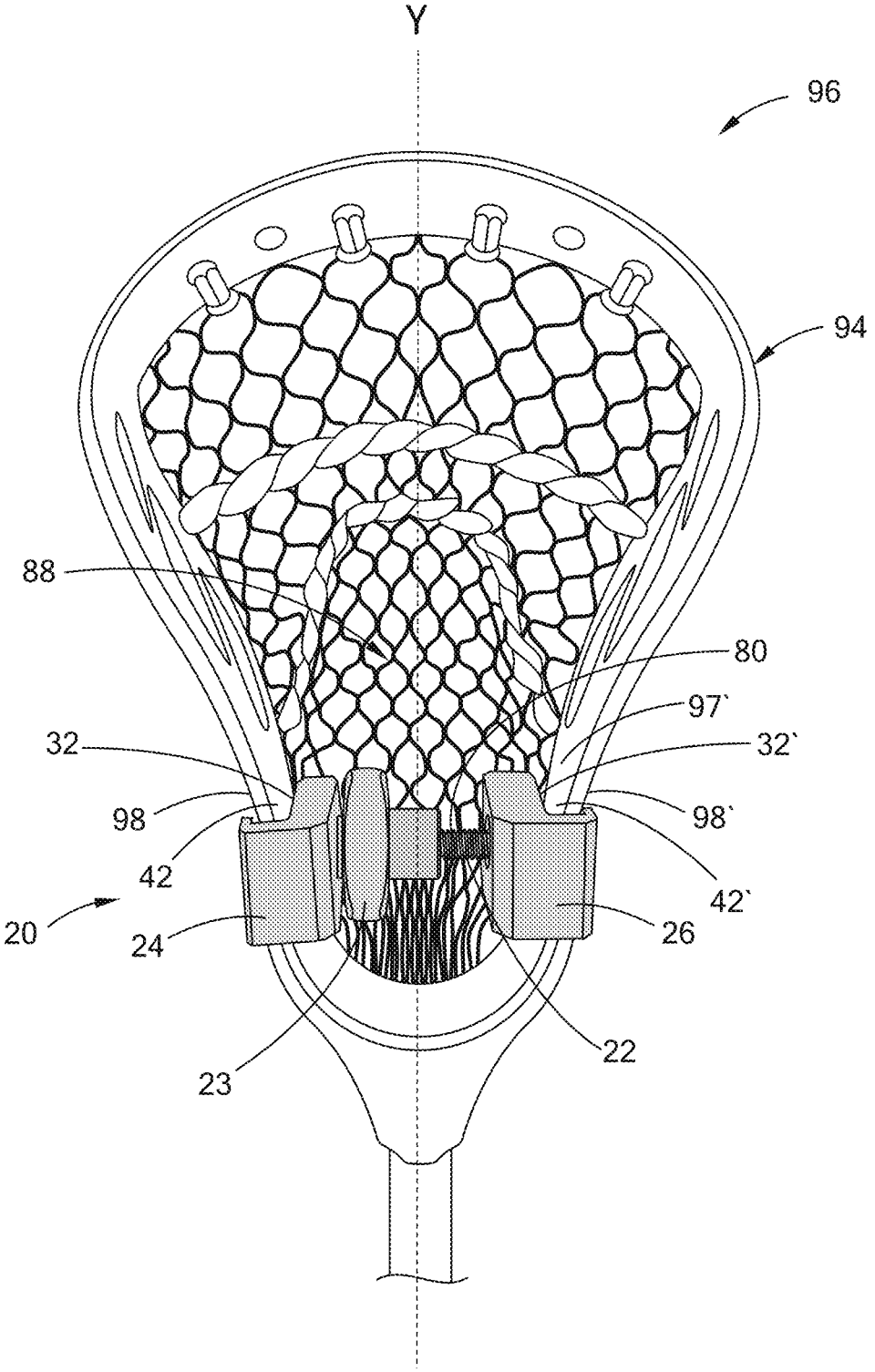
FIG. 1 illustrates an adjustment device installed in a head of a lacrosse stick according to the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIGS. 1-4B, an adjustment device for repositioning walls of athletic equipment according to the principles of the present disclosure is illustrated and generally indicated by reference numeral 20. As shown, the adjustment device 20 includes a base bracket 24 connected to a secondary bracket 26 via an adjustment member 22, and a knob 23 secured to the adjustment member 22.

In one form, the base bracket 24 and secondary bracket 26 have symmetrical geometries, and for simplicity purposes are illustrated throughout the figures having symmetrical geometries. However, the brackets 24, 26 are not restricted to having symmetrical geometries and the brackets 24, 26 may exhibit different geometries while still remaining within the scope of the present disclosure.

Each bracket 24, 26 includes a body 28, 28' having an inner face 30, 30', an outer face 32, 32', a proximal end portion 34, 34', a central portion 36, 36', and a distal end portion 38, 38'. The central portion 36, 36' defines an aperture 40, 40' having a geometric shape configured to receive opposed ends of the adjustment member 22, which is described in greater detail below.

Each bracket 24, 26 further includes a receiving portion 42, 42' at the proximal end 34, 34' of the body 28, 28' that is configured to receive and lock a corresponding wall of the athletic equipment. The receiving portion 42, 42' of each bracket 24, 26 includes a projection 44, 44' radially extending from the outer face 32, 32' of the body 28, 28', and a lip 46, 46' extending from an inner surface 48, 48' of the projection 44, 44' such that a slot 50, 50' is formed. More specifically, the proximal end 34, 34' of the body 28, 28', the projection 44, 44', and the lip 46, 46' collectively define the slot 50, 50'. Likewise, it can be said that the body 28, 28', the projection 44, 44', and the lip 46, 46' collectively form inner surfaces 52, 52' of the receiving portion 42, 42'.

The projection 44, 44' of the receiving portion 42, 42' has a slot width sufficient for the slot 50, 50' to receive the corresponding wall of the athletic equipment such that part of the wall comes into mating contact with at least one inner surface 52, 52' of the receiving portion 42, 42', thereby holding the walls of the athletic equipment stationary relative to the brackets 24, 26 for subsequent adjustment, which is described in greater detail below.

The present disclosure is not limited to this specific slot configuration and other configurations operable to receive and hold the walls of the athletic equipment may be employed while remaining within the scope of the present disclosure, one form of which is described in greater detail below.

The brackets 24, 26 may be any of a variety of materials durable for proper operation. In one form, the brackets 24, 26 are made of a wear resistant material, such as, for example, thermoplastic, aluminum, steel, carbon fiber or a material coated with a wear resistant material. Because the brackets 24, 26 come into mating contact with the walls of the athletic equipment, the walls may be susceptible to wear or damage at the abutment interface during operation.

Accordingly, in one form of the present disclosure, in order to inhibit damage or wearing of the walls during installation or while the device 20 is in a final installation position, each bracket 24, 26 includes at least one protection member 54 disposed proximate the walls of the athletic equipment.

Figure 2:
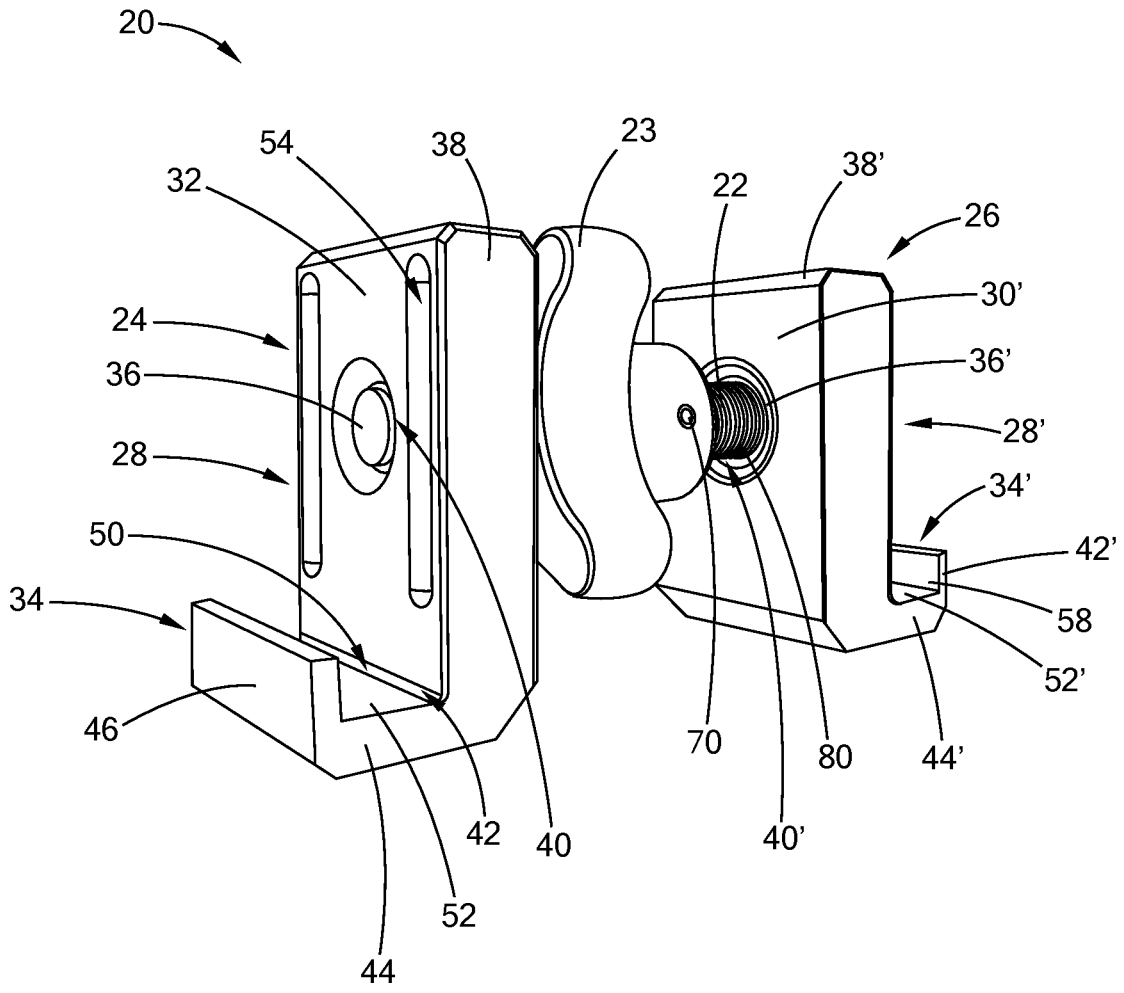
FIG. 2 is a left-side perspective view of the adjustment device of FIG. 1.
Figure 3:
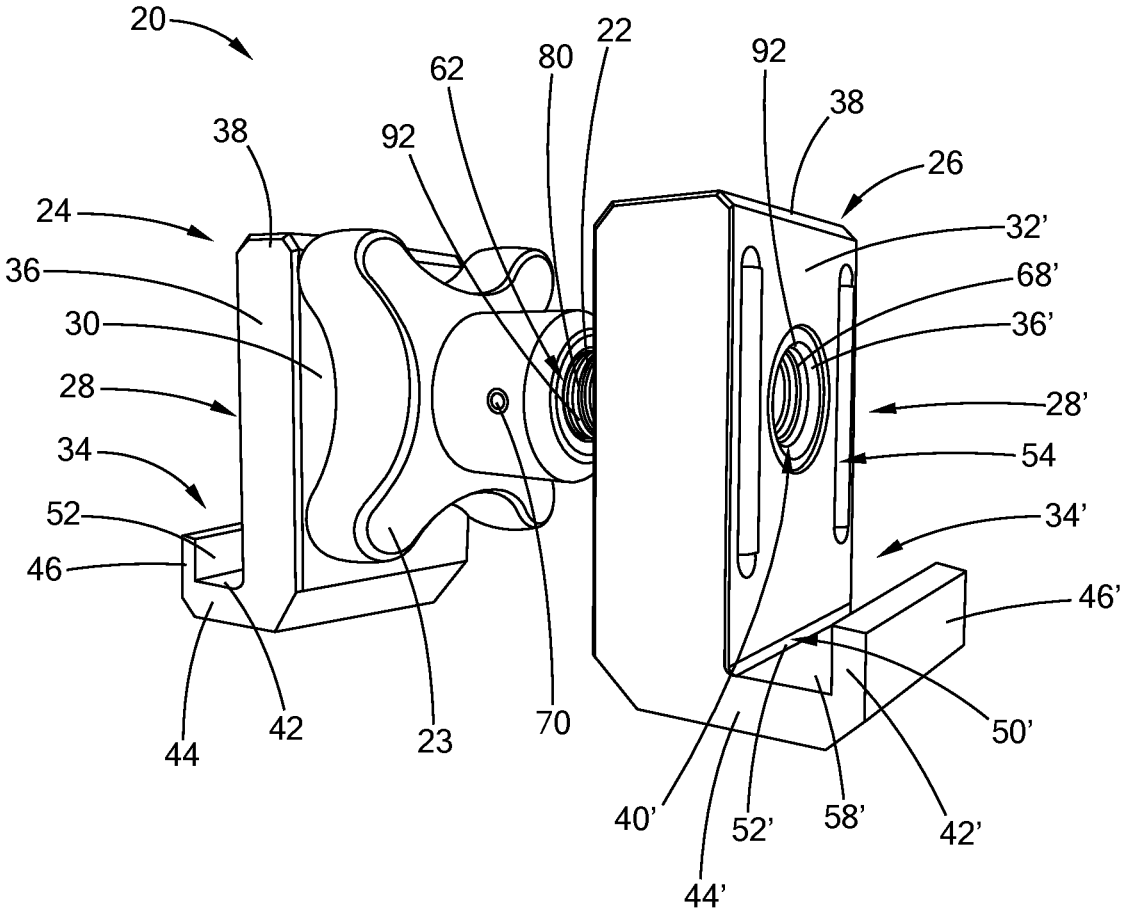
FIG. 3 is a right-side perspective view of the adjustment device of FIG. 1.
Figure 5:
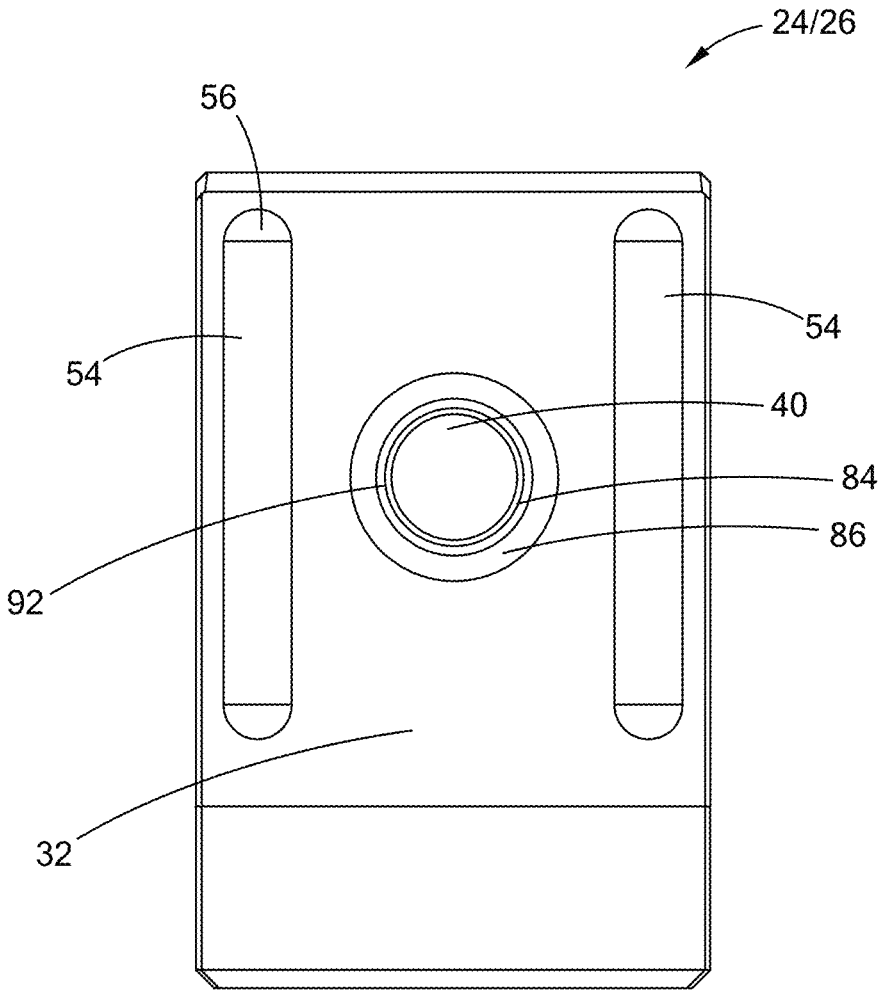
FIG. 5 is a front view of a secondary bracket according to the present disclosure.

As shown in FIGS. 2, 3, and 5, in one variant, two protection members 54 are disposed on the outer face 32, 32' of the bracket 24, 26. Each protection member 54 defines an elongated cylindrical shape adapted to engage a complementary cavity 56 formed on the outer face 32, 32' of the bracket 24, 26. Each protection member 54 defines a diameter greater than a diameter of the cavity 56 such that the cylindrical protection member 54 is press-fit within the cavity 56, or is elastically deformed/compressed to be secured within the cavity 56, depending on the material of the protection member 54. As illustrated, the protection members 54 are inserted into their complementary cavity 56 that extend parallel one another on opposed sides of the aperture 40, 40'. The depth of insertion of the protection member 54 into the cavity 56 is limited by a depth of the cavity 56, and in this example, the depth of the cavity 56 is less than the diameter of the cylindrical protection member 54. As a result, the cylindrical protection member 54 projects beyond the outer face 32, 32' of the bracket 24, 26 thereby providing a barrier between the outer face 32, 32' of the bracket 24, 26 and a surface of the wall of the athletic equipment. The protection member 54 may be any of a variety of materials configured to protect against damage, such as for example, silicone or any other material having protective properties.

It should be understood that the present disclosure is not limited to a press-fitting configuration and other joining methods may be employed to secure the protection member 54 to the brackets 24, 26, such as for example, adhesive bonding, mechanical fastening, welding, snap fitting, and/or the use of inserts, among others, either separately or in combination.

Furthermore, although two protection members 54 having an elongated cylindrical shape are illustrated on the outer face 32, 32 of the bracket 24, 26, any number of protection members 54, even one, and any geometric shape may be employed while still remaining within the scope of the present disclosure. Even further, the location of the protection member 54 is not limited to the outer face 32, 32' of the bracket 24, 26, and the protection member 54 may be disposed on any surface of the bracket 24, 26 that may come into contact with the walls of the athletic equipment to inhibit damage.

Figure 4A:
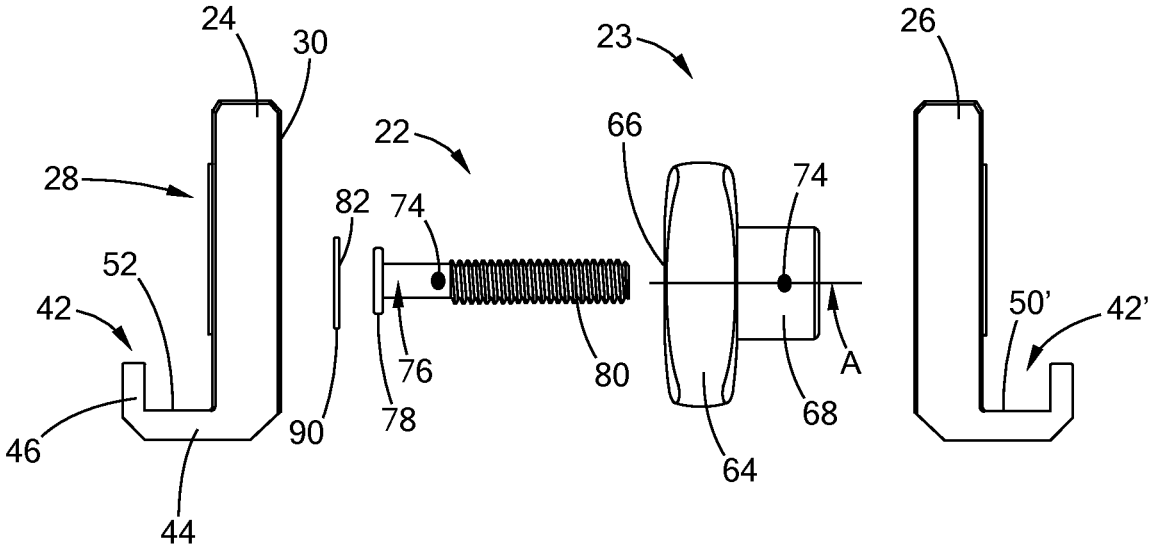
FIG. 4A is an exploded front view of the adjustment device of FIG. 1.
Figure 4B:
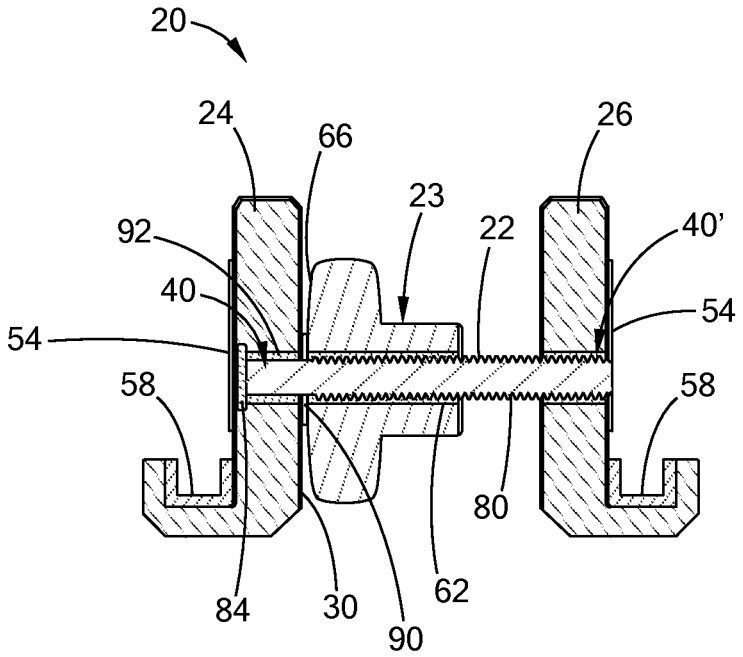
FIG. 4B is a cross-sectional view the adjustment device of FIG. 1.

As shown in FIG. 4B, in another variant, each bracket 24, 26 includes a barrier member 58 disposed on at least one inner surface 52, 52' of the receiving portion 42, 42' and/or any surface of the brackets 24, 26 that may come into contact with a surface of the wall to inhibit damage. Similar to the protection member 54, the barrier member 58 may be any of a variety of materials configured to protect against damage, such as for example, silicone or any other material having protective properties.

In one form, the barrier member 58 is a protective strip of silicone material configured to form a barrier between the bracket 24, 26 and the walls of the athletic equipment, thereby providing the desired protection. In this form, an adhesive is used to attach the protective strip to the inner surface 52, 52' of the receiving portion 42, 42'. Alternatively, the protective strip may be sprayed onto the surface. However, other joining methods may be employed while still remaining within the scope of the present disclosure.

The knob 23 of the device 20 includes a handle 64 having a top surface 66, and a shaft 68. The knob 23 defines a central aperture 62 (FIGS. 3 and 4B) extending along a central axis A (FIG. 4A) configured to receive the adjustment member 22. The knob 28 is fixedly secured to the adjustment member 22 such that the adjustment member 22 integrally rotates with the knob 28, as described in greater detail below.

As best shown in FIGS. 2 and 3, a stabilizing pin 70 extends through pin holes 72, 74 formed through both the shaft 68 of the knob 23 and the adjustment member 22, and functions to fixedly secure the knob 23 to the adjustment member 22. However, it should be understood that the knob 23 may be secured to the adjustment member 22 by any suitable method, such as for example adhesive bonding or other mechanical fastening means, among others, while still remaining within the scope of the present disclosure. Alternatively, the knob 23 and the adjustment member 22 may be formed as a single component.

Referring to FIGS. 4A, 4B, and 5, the adjustment member 22 is illustrated in the form of a rod having a head portion 76 including a flange 78, and an externally threaded portion 80. In this form, the aperture 40 of the base bracket 24 defines a circular geometric shape configured to receive the head portion 76 such that the base bracket 24 is rotatably attached around the head portion 76 of the adjustment member 22. More specifically, the adjustment member 22 is placed through the aperture 40 of the base bracket 24 and slides through the aperture 40 until a shoulder 84 disposed within the aperture 40 stops the adjustment member 22 from sliding further. Next, the adjustment member 22 is placed through the aperture 62 of the knob 23 such that the knob 23 is fixedly secured and cannot freely rotate around the adjustment member 22. In this configuration, the top surface 66 of the knob 23 engages with the inner face 30 of the base bracket 24. Once the knob 23 is secured to the adjustment member 22, the base bracket 24 can freely rotate about the head portion 76 of the adjustment member 22.

In another form, the adjustment device 20 includes a load bearing member 90 disposed around the rod 22 and between the base bracket 24 and the knob 23 to inhibit the knob 23 from engaging the inner face 30 of the base bracket 24 and to bear loads during normal operation. In one form, the load bearing member 90 is a washer.

Like the aperture 40 of the base bracket 24, the aperture 40' of the secondary bracket 26 defines a circular geometric configuration. However, unlike the aperture 40 of the base bracket, the adjustment member 22 threadably engages with internal threads of the aperture 40' of the secondary bracket 26, which is described in greater detail below.

The apertures 40, 40' of the brackets 24, 26 and/or the aperture 62 of the knob 23 may include a wear-resistant insert 92 (best shown in FIG. 5) made of a material with an increased hardness relative to the brackets 24, 26, such as a steel insert bonded into the apertures 40, 40', 62. The wear-resistant insert 92 provides additional durability, a longer life, and inhibits stripping of the brackets 24, 26 and the interior of the knob 23 by the adjustment member 22, which are generally a material softer than the wear-resistant inserts 92.

Figure 6A:
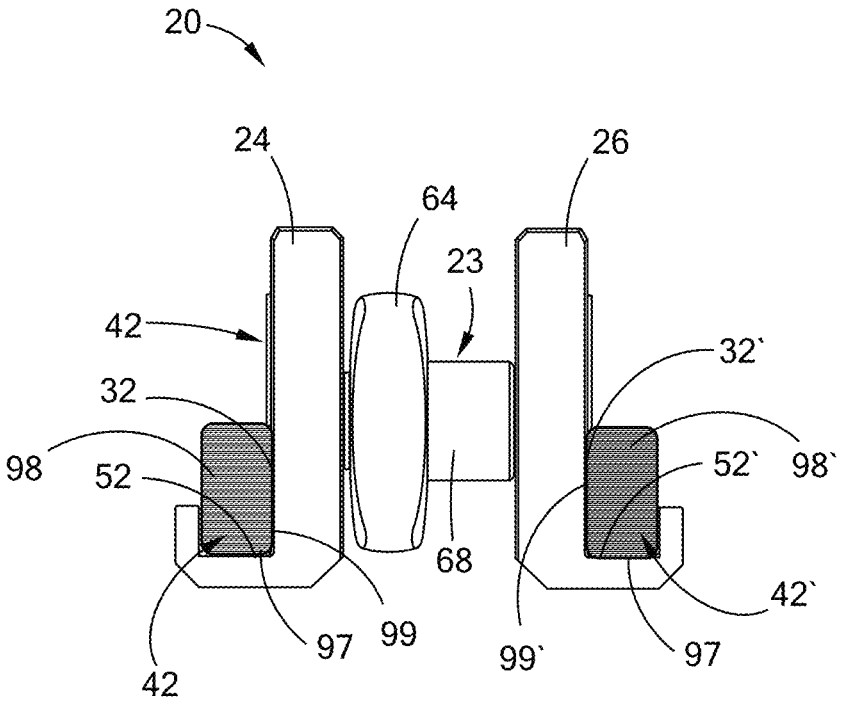
FIG. 6A is a top view of the adjustment device of FIG. 1 in a fully retracted position and engaged with sidewalls of a lacrosse head according to the teachings of the present disclosure.
Figure 6B:
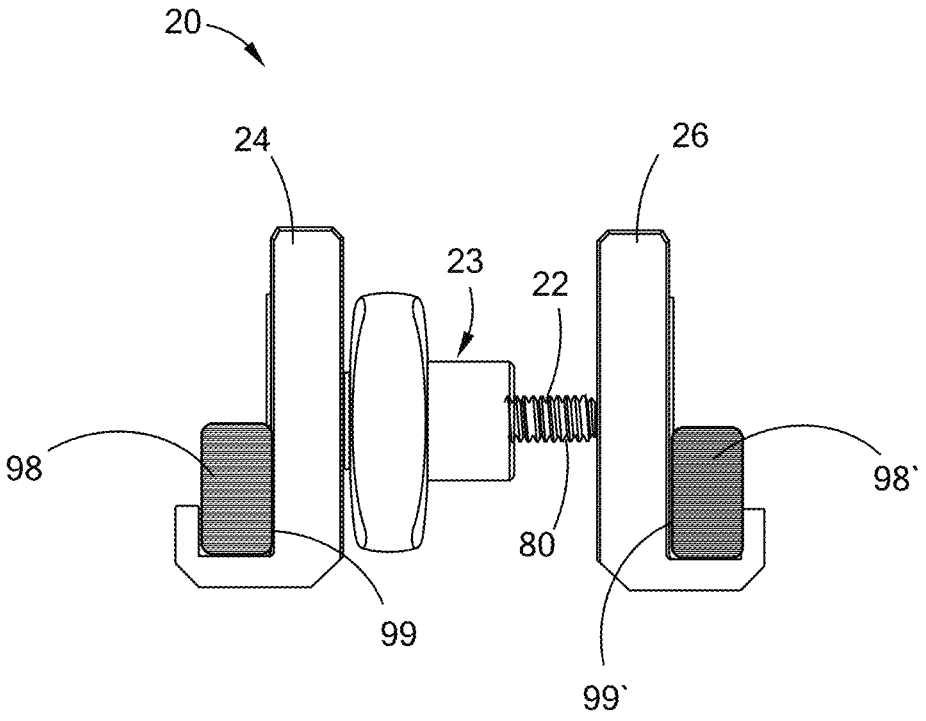
FIG. 6B is a top view of the adjustment device of FIG. 1 in a partially extended position and engaged with sidewalls of a lacrosse head according to the teachings of the present disclosure.
Figure 6C:
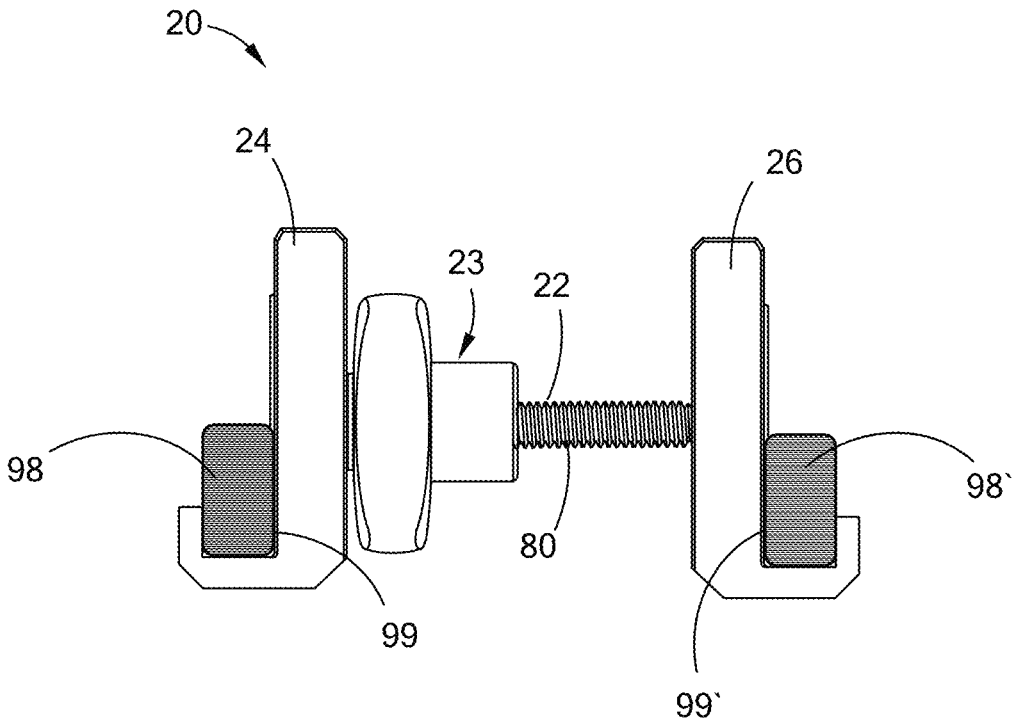
FIG. 6C is a top view of the adjustment device of FIG. 1 in a fully extended position and engaged with sidewalls of a lacrosse head according to the teachings of the present disclosure.

Referring to FIGS. 6A-6C, operation of the adjustment device 20 is illustrated through a series of progressive illustrations. For exemplary purposes, the device 20 is illustrated secured to a head 94 proximate a pocket of a lacrosse stick 96 that is symmetrical about its vertical axis Y (FIG. 1).

In FIG. 6A, the adjustment device 20 is in a fully retracted position and engaged with sidewalls 98, 98' of the head 94 of the lacrosse stick 96. For installation, the receiving portion 42 of the base bracket 24 receives a first sidewall 98 and the inner surfaces 52 of the receiving portion 42 of the base bracket 24 engages with a front portion 97 of the first sidewall 98, thereby holding the first sidewall 98. Likewise, the receiving portion 42' of the secondary bracket 26 receives an opposed second sidewall 98' and the inner surface 52' of the receiving portion 42' of the secondary bracket 26 engages with a front portion 97' of the second sidewall 98', thereby locking the second sidewall 98'.

Once the first and second sidewalls 98, 98' are received by the receiving portions 42, 42' of the brackets 24, 26, the adjustment device 20 is secured in place and the outer face 32 of the base bracket 24 mates with an inner surface 99 of the first sidewall 98 and the outer face 32' of the secondary bracket 26 mates with an inner surface 99' of the second sidewall 98'.

Alternatively, if the brackets 24, 26 include at least one protection member 54 and/or a barrier member 58, a barrier is formed between the bracket 24, 26 and the sidewalls 98, 98'. Thus, instead of the outer faces 32, 32' coming into mating contact with the inner surfaces 99, 99' of the sidewalls 98, 98', the protection member 54 and/or barrier member 58 comes into mating contact with the inner surfaces 99, 99' of the sidewalls 98, 98'. Advantageously, the risk of damage to the head 94 of the lacrosse stick 96 is reduced.

In FIG. 6B, the adjustment device 20 is in a partially extended position. As a user rotates the knob 23, the rod 22 integrally rotates with the knob 23 (either clockwise or counterclockwise according to the threaded directions) and are operable to move the secondary bracket 26 further away from the base bracket 24. In other words, as the knob 23 and rod 22 integrally rotate, for example in a clockwise direction, the externally threaded portion 80 of the rod 22 engages with the internal threads 68 of the secondary bracket 26 causing the secondary bracket 26 to move in a direction away from the base bracket 24 thereby increasing the distance between the base bracket 24 and secondary bracket 26. Because the base bracket 24 is configured to freely rotate about the head portion 76 of the rod 22, the first sidewall 98 remains locked into the base bracket 24 during operation of the adjustment device.

As the knob 23 and rod 22 integrally rotate and the brackets 24, 26 move further apart, pressure from each bracket 24, 26 is applied to the inner surface 99, 99' of the sidewalls 98, 98' and the sidewalls 98, 98' move with the brackets 24, 26 in a direction away from each other, thereby plastically deforming the sidewalls 84, 86.

Moving to FIG. 6C, once the desired distance between the two sidewalls 98, 98' is achieved, the brackets 24, 26 are held in place by the threaded connection between the rod 22 and secondary bracket 26. The sidewalls 98, 98' remain locked in the brackets 24, 26 at the desired distance for a predetermined duration until the sidewalls 98, 98' maintain the desired distance to comply with league rules.

Notably, to decrease the distance between the sidewalls 98, 98', the knob 23 and rod 22 are rotated in an opposite direction, for example in a counterclockwise direction, and the externally threaded portion 80 of the rod 22 engages with the internal threads 68 of the secondary bracket 26 causing the secondary bracket 26 to move in a direction towards the base bracket 24.

It should be understood that the base bracket 24 and secondary bracket 26 may be switched such that the base bracket 24 receives the second sidewall 98' and the secondary bracket 26 receives the first sidewall 98.

Figure 7:
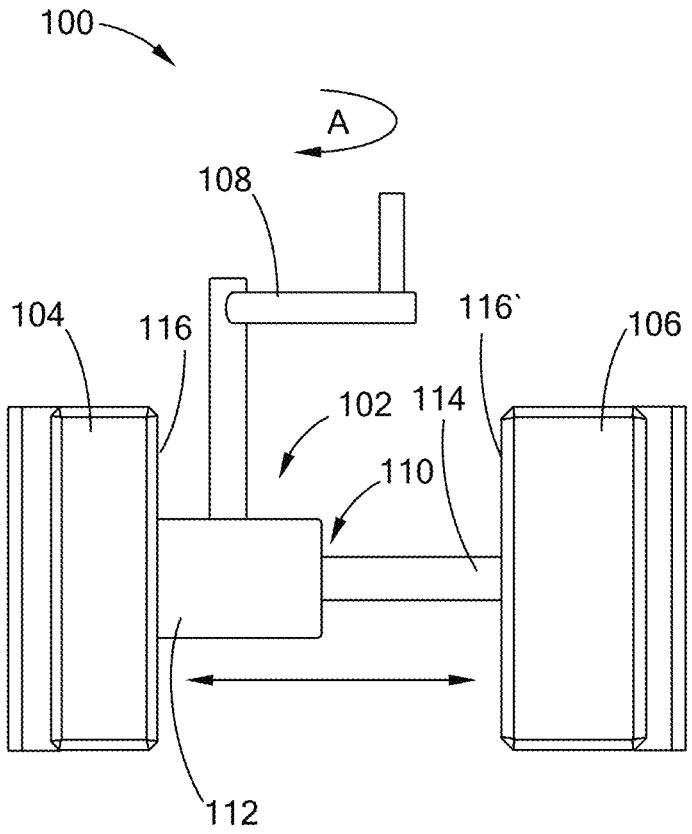
FIG. 7 is a front view of an adjustment device according to another form of the present disclosure.

Referring now to FIG. 7, an adjustment device 100 according to another form of the present disclosure is provided that includes a base bracket 104 connected to a secondary bracket 106 via an adjustment member 102. The base bracket 104 and secondary bracket 106 may include all or some of the various features of the brackets 24, 26 described above, however, differ in the way the brackets 104, 106 are secured to the adjustment member 102.

In this form, the adjustment member 102 is a rod 110 that includes a first end 112, a second end 114, and a handle 108 rotatably mounted on the first end 112 of the rod 110. The first end 112 of the rod 110 is secured to an inner face 116 of the base bracket 104 and the second end 114 of the rod 110 is secured to an inner face 116' of the secondary bracket 106.

Any of a variety of joining methods may be employed, such as for example, fastening, welding, adhesive bonding, inserts, snap and/or press fits, among others, while still remaining within the scope of the present disclosure. Depending on the joining method employed, the brackets 104, 106 may or may not define an aperture.

The first end 112 of the rod 110 defines a diameter greater than a diameter of the second end 114, wherein the first end 112 and the second end 114 are slideably engaged such that the rod 110 extends or condenses depending on the rotational direction of the handle 108. For example, when the handle 108 is rotated in a clockwise direction A, the second end 114 extends from the first end 112 and the secondary bracket 106 moves in a direction away from the base bracket 104.

Alternatively, the rod 110 does not include a handle 108. Instead, the first end 112 defines internal threads that engage with external threads of the second end 114. In this form, both the base bracket 104 and the secondary bracket 106 are rotatably secured to the rod 110. When the first end 112 is rotated about second end 114 (either clockwise or counterclockwise according to the threaded directions), the externally threaded portion of the second end 114 engages with the internally threads of the first end 112 causing the distance between the base bracket 104 and secondary bracket 106 to increase, thereby stretching the sidewalls 98, 98' of the lacrosse stick 96.

Figure 8:
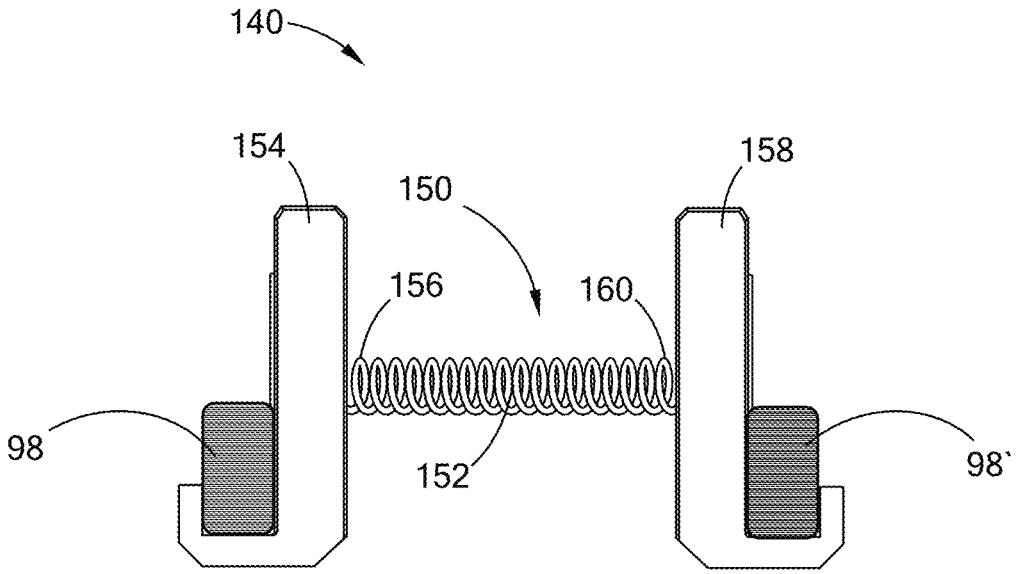
FIG. 8 is a top view of an adjustment device according to another form of the present disclosure.

In FIG. 8, another form, the adjustment device 140 according to another form of the present disclosure is provided that includes a base bracket 154 connected to a secondary bracket 158 via an adjustment member 150. In this form, the adjustment member 150 is a resilient extension 152 having a first end 156 and a second end 160. The base bracket 154 is secured around the first end 156 of the resilient extension 152 and the secondary bracket 158 secured around the second end 160 of the resilient extension 152.

In one variation, the resilient extension 152 is a compression spring 152 configured to apply force to move the base bracket 154 and secondary bracket 158 in opposite directions. When the brackets 154, 158 are secured to the sidewalls 98, 98' of the lacrosse stick 96, the spring 152 is in a compressed state which applies force to both brackets 154, 158 to move the brackets 154, 158 in opposite directions, thereby stretching the sidewalls 98, 98'.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An adjustment device for use in adjusting sidewalls of a lacrosse head proximate a pocket, the adjustment device comprising:

a rod having an externally threaded portion and a head portion;

a base bracket defining an aperture and rotatably secured around the head portion of the rod, the base bracket comprising a receiving portion including a projection radially extending from the base bracket and configured to receive and lock the sidewalls of the lacrosse head;

a secondary bracket defining a corresponding aperture, the corresponding aperture having internal threads configured to engage with the externally threaded portion of the rod, the secondary bracket comprising a receiving portion including a projection radially extending from the base bracket and configured to receive and lock the sidewalls of the head; and a knob secured to the rod, wherein the rod and the knob integrally rotate and are operable to move the secondary bracket in a direction away from the base bracket.

2. The adjustment device according to claim 1 wherein the knob is secured to the rod with a stabilizing pin that extends through both the knob and the rod.

3. The adjustment device according to claim 1, wherein the receiving portion defines a slot.

4. The adjustment device according to claim 1, wherein each of the base bracket and the secondary bracket further includes at least one protection member proximate the sidewall of the lacrosse head.

5. The adjustment device according to claim 4, wherein the at least one protection member is disposed within a cavity located on an outer face of the base bracket and an outer face of the secondary bracket, and a portion of the protection member protrudes from the cavity.

6. The adjustment device according to claim 4, wherein the at least one protection member is a protective strip on at least one surface of each of the base bracket and the secondary bracket.

7. The adjustment device according to claim 1 wherein each of the base bracket and the secondary bracket are a material selected from the group consisting of thermoplastic, steel, carbon fiber, aluminum, and combinations thereof.

8. The adjustment device according to claim 1, wherein at least one surface of each of the receiving portion of the base bracket and the secondary bracket includes a barrier member for protecting a surface of the sidewalls of the lacrosse head.

9. The adjustment device according to claim 1, wherein the base bracket and the secondary bracket are symmetrical.

10. A device for repositioning walls of a lacrosse head, the device comprising:

an adjustment member;

a base bracket secured around one end of the adjustment member, the base bracket comprising a receiving portion including a projection radially extending from the base bracket and configured to receive and lock a wall of the lacrosse head; and a secondary bracket secured around an opposed end of the adjustment member, the secondary bracket comprising a receiving portion including a projection radially extending from the base bracket and configured to receive and lock another wall of the lacrosse head, wherein the adjustment member is operable to move the secondary bracket in a direction away from the base bracket.

11. The device of claim 10, wherein the adjustment member is a resilient extension.

12. The device of claim 11, wherein the resilient extension is a compression spring configured to apply force to move the base bracket and secondary bracket in opposite directions.

13. The device of claim 10, wherein the adjustment member is a rod including a handle and operable to extend when the handle is rotated such that the base bracket and secondary bracket move in a direction away from each other.

14. The device of claim 10, wherein the adjustment member is a threaded rod.

15. The device of claim 10 further comprising at least one protection member disposed on each of the base bracket and the secondary bracket for protecting a surface of the walls of the lacrosse head.

16. The device of claim 15, wherein the at least one protection member is disposed within a cavity located on a front face of the base bracket and a front face of the secondary bracket, and a portion of the protection member protrudes from the cavity.

17. The device of claim 15, wherein the at least one protection member is a protective strip on at least one surface of the first bracket and the second bracket.

18. The device of claim 10, wherein at least one surface of the receiving portion of the base bracket and the secondary bracket includes a barrier member for protecting a surface of the walls of the lacrosse head, and wherein the barrier member is at least one of disposed within a cavity or is a protective strip located on the at least one surface of the receiving portion of each of the base bracket and the secondary bracket.

19. The device of claim 10, wherein the receiving portion defines a slot.

20. The device of claim 10, wherein each of the base bracket and the secondary bracket are made of a material selected from the group consisting of thermoplastic, metal, carbon fiber, and combinations thereof.

* * * * *